US005346321A

United States Patent [19]

Eudy

[11] Patent Number: 5,346,321

[45] **Date of Patent: * Sep. 13, 1994**

[54] PRINTER WITH EDGE STRIP TRIMMER INCLUDING A DOWNWARDLY EXTENDING EDGE SURFACE

[76] Inventor: James R. Eudy, 4316 Whitetail La., Midland, N.C. 28107

[ * ] Notice: The portion of the term of this patent subsequent to Mar. 2, 2010 has been disclaimed.

[21] Appl. No.: 34,118

[22] Filed: Mar. 22, 1993

Related U.S. Application Data

[63] Continuation-in-part of Ser. No. 947,751, Sep. 21, 1992, which is a continuation-in-part of Ser. No. 826,820, Jan. 28, 1992, Pat. No. 5,190,386.

[51] Int. Cl.[5] ..... B41J 11/26

[52] U.S. Cl. ..... 400/621.1; 101/483

[58] Field of Search ..... 400/621.1; 101/483

[56] References Cited

U.S. PATENT DOCUMENTS

| | | | |
|---|---|---|---|
| 3,253,544 | 5/1966 | Hope | 101/483 |
| 3,253,545 | 5/1966 | Carleton | 101/483 |
| 4,540,612 | 9/1985 | Rhyner | 281/2 |
| 4,814,216 | 3/1989 | Brunett et al. | 281/2 |
| 5,219,631 | 6/1993 | Long | 281/5 |

*Primary Examiner*—Edgar S. Burr
*Assistant Examiner*—Anthony H. Nguyen
*Attorney, Agent, or Firm*—W. Thad Adams, III

[57] ABSTRACT

A printer having first and second opposed sprockets positioned on opposed sides of a printer platen for feeding from an upstream to a downstream direction continuous-feed paper sheets having continuous-feed edge strips formed along the opposing sides of the paper sheets. An edge strip trimming apparatus includes first and second edge strip trimmers. Each of the edge strip trimmers have edge strip hold-down devices positioned in closely spaced-apart relation to one of the first and second sprockets for holding the edge strip against the sprocket as the paper is fed through the printer. An inclined paper support bed extends inwardly from the edge strip hold-down device to a point underneath the horizontal plane of the paper sheet for progressively diverging the plane of the edge strip from the plane of the paper sheet as the paper sheets are successively fed through the printer. The support bed defines an edge surface. The edge surface extends downwardly, beneath the hold-down device, to ensure that each paper sheet is properly passed through the edge strip trimmer and separated from its respective edge strip.

16 Claims, 6 Drawing Sheets

10

PRINTER WITH EDGE STRIP TRIMMER INCLUDING A DOWNWARDLY EXTENDING EDGE SURFACE

This application is a continuation-in-part of application Ser. No. 947,751, filed on Sep. 21, 1992, which is a continuation-in-part of application Ser. No. 826,820, filed on Jan. 28, 1992, now Pat. No. 5,190,386.

TECHNICAL FIELD AND BACKGROUND OF THE INVENTION

The invention relates to a printer which feeds continuous feed paper sheets through the printer by means of edge strips which are formed on opposite sides of the paper sheets. Such printers range from very expensive, high speed line printers to very inexpensive printers sold primarily for small business and home use. Such printers use paper which is in a continuous length, but with spaced-apart, laterally-extending perforation lines. The paper can be separated into individual sheets when desired by tearing along the perforation line.

According to the applicant's pending U.S. patent application, Ser. No. 947,751, filed on Sep. 21, 1992, the paper sheets are automatically separated by using a particular length of continuous-feed paper. The length of continuous-feed paper includes pre-separated sheets of paper attached solely by edge strips located on opposite side edges of the paper. As the edge strips are removed, the paper sheets separate and become disconnected from the continuous length.

The edge strips are separable from the paper sheets by means of perforation lines which extend along the length of the paper sheets. The perforation lines define the edge strip and paper sheets on opposite sides thereof. The edge strips have holes which extend along its length at regularly spaced-apart intervals which match the spacing of sprocket teeth on the axially-extending peripheral surface of sprocket wheels which are positioned on opposite sides of the printer at the paper platen.

The edge strips are usually manually torn from the paper sheets after the paper has been removed from the printer. This is a tedious, time consuming job. For this reason, those trimming the edge strips manually tend to try to remove the edge strips from a number of sheets at the same time by fan folding the sheets, if they are not already fan folded. If too many layers are stripped at the same time, the edge strip can fail to separate cleanly, and can either leave a ragged remnant of the edge strip attached to the paper sheet, or can tear into the paper sheet, thereby requiring that sheet to be re-printed.

The invention of this application relates to an improved edge strip trimmer for particular use with a length of continuous-feed paper according to the applicant's pending U.S. patent application, Ser. No. 947,751. Since this particular length of continuous-feed paper does not include laterally-extending perforation lines for attaching the top and bottom edges of the paper sheet to adjacent sheets, the top and bottom edges of the sheet tend to sag when passed through the printer and respective edge strip trimmers. This creates a problem, since each sheet must pass over a support bed of the edge strip trimmer to be separated from its edge strip. If the top or bottom edge of the sheet sags, the sheet may pass under instead of over the support bed of the trimmer. Thus, the edge strip will not be trimmed, and the sheets will not be properly separated.

The edge strip trimmer of the present application eliminates this problem by proving an lengthened and curved support bed for ensuring that each sheet of paper is properly fed through the edge strip trimmers.

SUMMARY OF THE INVENTION

Therefore, it is an object of the invention to provide a printer which includes a pair of edge strip trimmers for trimming the edge strip from a paper sheet.

It is another object of the invention to provide an edge strip trimmer which can be attached to a conventional printer in order that the edge strips attached to continuous-feed paper sheets can be removed automatically as the paper sheets are printed and fed from the printing zone of the printer.

It is another object of the invention to provide an edge strip trimmer which includes a lengthened and curved support bed for ensuring that each paper sheet is properly passed though the edge strip trimmer and separated from the continuous length of paper.

These and other objects of the present invention are achieved in the preferred embodiments disclosed below by providing a printer having first and second opposed sprocket wheels positioned on opposed sides of a printer platen for feeding from an upstream to a downstream direction continuous-feed paper sheets having continuous-feed edge strips formed along the opposing sides of the paper sheets. The printer further includes the combination of an edge strip trimming apparatus. The edge strip trimming apparatus includes first and second edge strip trimmers.

Each of the edge strip trimmers include an edge strip hold-down device positioned in closely spaced-apart relation to one of the first and second sprocket wheels for holding the edge strip against the sprocket wheel as the paper is fed through the printer. A separating means separates the edge strip from the paper sheet, and includes a paper sheet support bed for extending inwardly from the edge strip hold-down device to a point underneath the horizontal plane of the paper sheet. The separating means progressively diverges the plane of the edge strip from the plane of the paper sheet as the paper sheets are successively fed through the printer. An edge surface defined by the support bed, has a gradual compound curve which tapers forwardly in the direction from which the paper sheets are fed through the printer and downwardly to a point beneath the edge strip hold-down device. The edge surface extends downwardly to ensure separation of the edge strip from each successive paper sheet as the sheets are progressively fed through the printer.

According to one preferred embodiment of the invention, the continuous-feed paper sheets include a multiplicity of adjacent paper sheets aligned end-to-end for being fed into the printer. Each of the sheets are defined from adjacent sheets by a cut through the paper. The cut extends transversely from one side edge of the paper sheets to the other side edge of the paper sheets.

First and second continuous paper edge strips are formed on opposite side edges of the paper sheets, and extend along the length of the continuous-feed paper for carrying the paper sheets therebetween. The first and second edge strips have sprocket holes therein for permitting the edge strips and the paper sheets carried by the edge strips to be continuously fed through a sprocket-driven printer. The first and second edge strips and the paper sheets are separable along the length of the continuous-feed paper between the first paper edge strip and one side edge of said paper sheet, and along the length of continuous-feed paper between the second paper edge strip and the other side edge of said paper sheet. Upon separation of the first and second paper edge strips from the paper sheets, the paper sheets are completely separated from each other.

According to another preferred embodiment of the invention, the sprocket wheel includes sprocket teeth spaced around an axially extending periphery of the sprocket wheel, and the edge strip hold-down device is annular for being positioned in closely conforming relation to the curved surface of the sprocket wheel.

According to yet another preferred embodiment of the invention, the sprocket wheel has sprocket teeth spaced around the periphery thereof. The sprocket wheel has a relatively straight upper and lower surface, and a curved first and second side portion. The edge strip hold-down device is relatively straight for being positioned in closely conforming relation to one of the relatively flat upper or lower surfaces of the sprocket wheel.

Preferably, the edge strip trimmers are integrally formed from a hard plastic material.

Preferably, the edge strip trimmers are positioned on pivots for being pivoted into and out of cooperation with the sprocket wheel.

Preferably, the edge strip trimmers are integrally-formed with the pivots.

According to yet another preferred embodiment of the invention, the printer includes paper sheet hold-down device attached to the edge strip hold-down device. The paper sheet hold-down device extends inwardly into the vertical plane of the paper sheet and above the horizontal plane of the paper sheet in upstream orientation to the edge surface for holding the paper sheet close to the platen until separation from the edge strip begins.

According to one preferred embodiment of the invention, the edge strip trimmer is attached to one side of a printer. The edge strip trimmer includes a sprocket wheel which feeds from an upstream to a downstream direction continuous-feed paper sheets having continuous-feed edge strips formed along the opposing sides of the paper. The edge strip trimmer further includes an edge strip hold-down device positioned in closely spaced-apart relation to the sprocket wheel for holding the edge strip against the sprocket wheel as the paper is fed through the printer. A separating means separates the edge strip from the paper sheet. The separating means includes an inclined paper support bed for extending inwardly from the edge strip hold-down device to a point underneath the horizontal plane of the paper sheet for progressively diverging the plane of the edge strip from the plane of the paper sheet as the paper sheets are successively fed through the printer.

An edge surface is defined by the support bed. The edge surface has a gradual compound curve which tapers forwardly in the direction from which the paper sheets are fed through the printer and downwardly to a point beneath the edge strip hold-down device. The edge surface extends downwardly to ensure separation of the edge strip from each successive paper sheet as the sheets are progressively fed through the printer.

According to yet another preferred embodiment of the invention, the edge strip trimmer includes an edge strip hold-down device which is annular for being positioned in closely conforming relation to the curved surface of a sprocket wheel. The sprocket wheel has sprocket teeth spaced around a axially extending periphery thereof.

According to yet another preferred embodiment of the invention, the edge strip trimmer includes a sprocket wheel having sprocket teeth spaced around the periphery thereof. The sprocket wheel has a relatively flat upper and lower surface, and a curved first and second side portion. The edge strip hold-down device is relatively straight for being positioned in closely conforming relation to one of the relatively flat upper or lower surfaces of the sprocket wheel.

Preferably, the edge strip trimmer is positioned on a pivot for being pivoted into and out of cooperation with the sprocket wheel.

Preferably, the edge strip trimmer is integrally formed from a hard plastic material.

According to one preferred embodiment of the invention, the edge strip trimmer is integrally-formed with the pivot.

According to another preferred embodiment of the invention, the edge strip trimmer includes paper sheet hold-down device attached to the edge strip hold-down device. The paper sheet hold-down device extends inwardly into the vertical plane of the paper sheet and above the horizontal plane of the paper sheet in upstream orientation to the edge surface for holding the paper sheet close to the platen until separation from the edge strip begins.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

Figure 1:
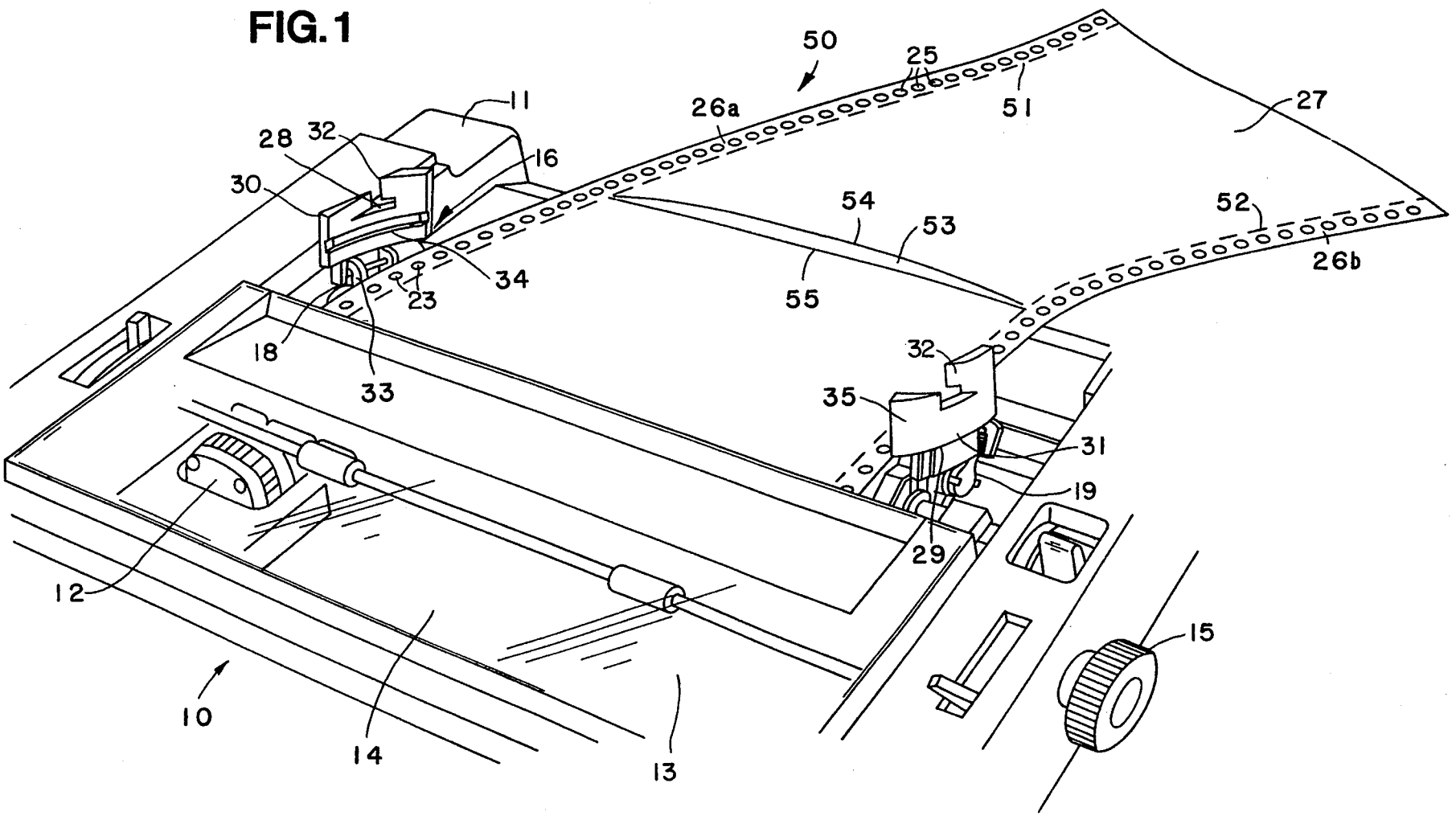
FIG. 1 is a fragmentary perspective view of a printer including a pair of edge strip trimmers according to an embodiment of the invention in their inoperative position.

Referring now specifically to the drawings, a printer according to the present invention is illustrated in FIG. 1 and shown generally at reference numeral 10. The printer 10 includes a printer housing 11, a print head 12, a transparent cover 13, and a platen 14 to which a platen knob 15 is attached for manual feeding of the paper through the printer 10.

Figure 2:
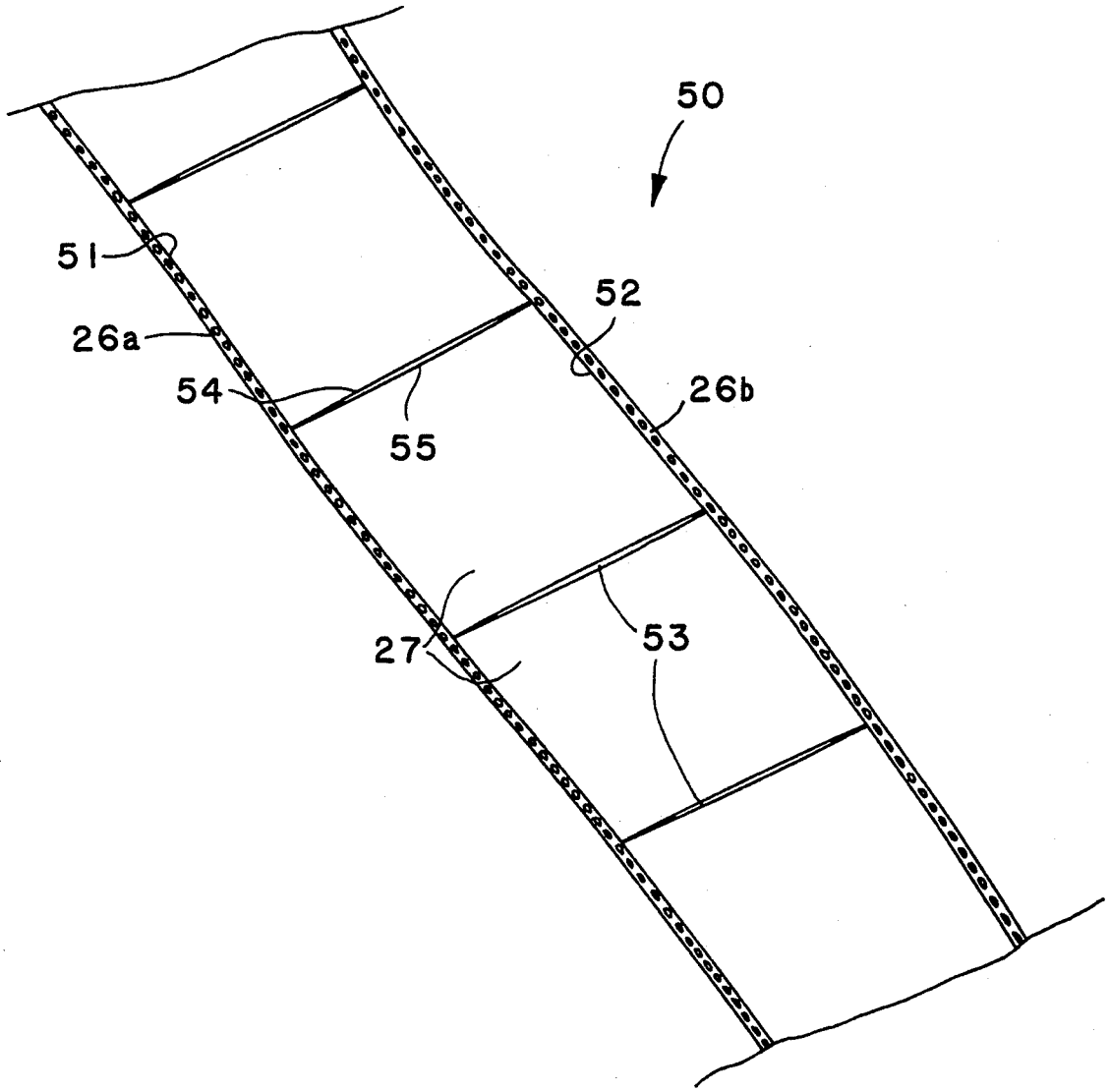
FIG. 2 is a fragmentary perspective view of a particular length of continuous-feed paper product.

In FIG. 2, a particular length of continuous-feed paper is illustrated, and referenced generally at 50. The length of continuous-feed paper 50 is formed by attaching respective edge strips 26*a* and 26*b* to the side edges 51 and 52 of a multiplicity of adjacent paper sheets 27 aligned end-to-end for being fed into the printer 10. Preferably, the edge strips 26*a* and 26*b* are defined on opposite lateral sides of the paper sheet 27 by perforation lines. Each of the sheets are defined from adjacent sheets by a laterally extending cut 53 through the paper. The cut extends from one side edge 51 of the paper sheets to the other side edge 52 of the paper sheets. The edge strips 26*a* and 26*b* act to connect the paper sheets 27 in registration to form a continuous length of continuous-feed paper 50. Because of the laterally extending cut 53, respective top and bottom end sections 54 and 55 of the paper sheets 27 tend to sag or bend in the middle.

Referring back to FIG. 1, the continuous-feed paper sheets 50 are pulled through the printer 10 by a tractor feed apparatus 16. The tractor feed apparatus 16 includes a pair of tractor feed sprocket wheels 18 and 19 which are spaced-apart the proper distance to accommodate paper sheets of a given width.

Figure 3:
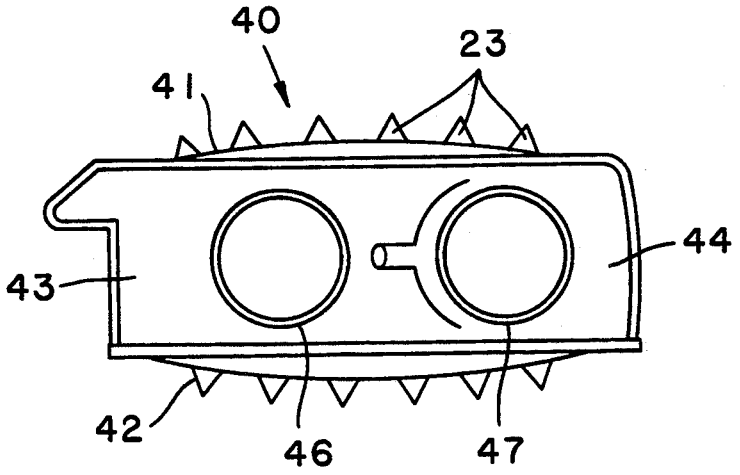
FIG. 3 is a side elevation of a sprocket wheel according to one embodiment of the invention.
Figure 4:
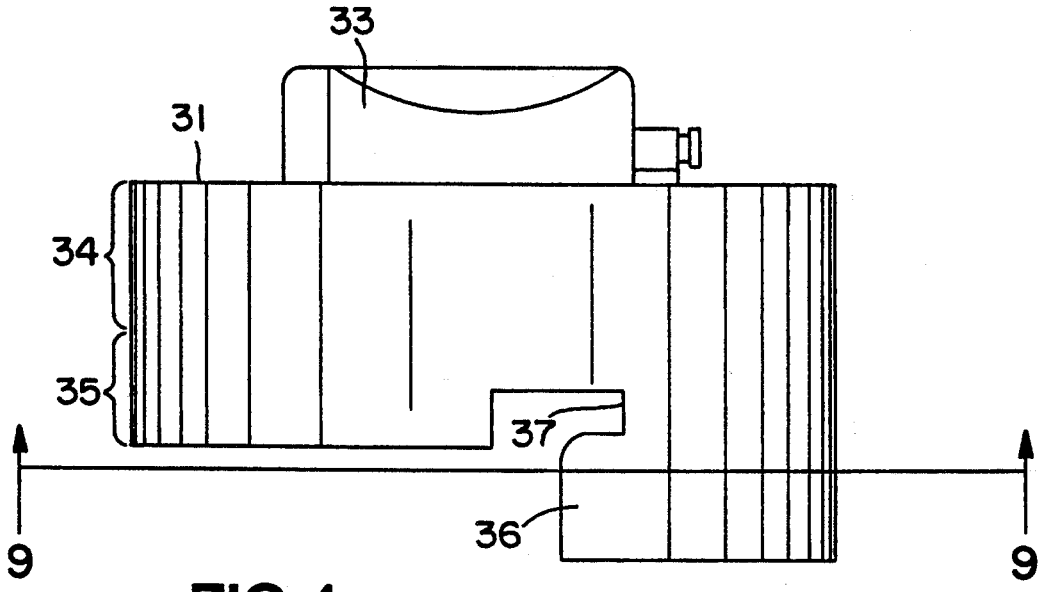
FIG. 4 is a top plan view of an edge strip trimmer according to one embodiment of the present invention.
Figure 10:
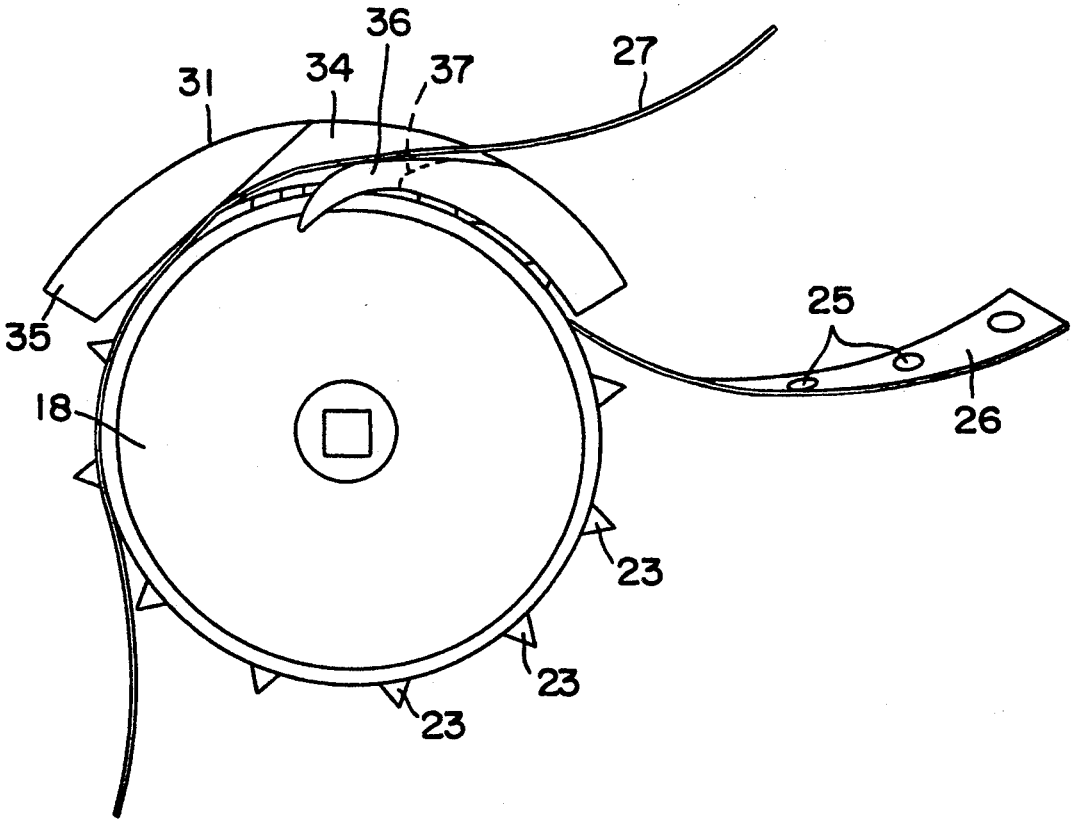
FIG. 10 is a side elevation showing the feed paths of the edge strip and paper sheet though the edge strip trimmer.

Sprocket wheels 18 and 19 have sprocket teeth 23 molded into their respective axially-extending peripheral surfaces (See FIGS. 3 and 10). As best shown in FIG. 10, sprocket wheels of one embodiment are annular. According to another embodiment of the sprocket wheel, shown in FIG. 3, the sprocket wheel 40 includes an upper and lower substantially flat area 41 and 42, and first and second curved portions 43 and 44. Preferably, the sprocket wheel 40 of this embodiment is constructed of two or more annular gears 46 and 47 adjacently positioned and spaced-apart for providing an area which is relatively flat, and an area which is curved.

As is best shown in FIG. 10, sprocket teeth 23 are spaced to match the spacing of holes 25 in the edge strip 26 defined on opposite lateral sides of the paper sheet 27 by perforation lines. The edge strips 26 are held onto the sprocket wheels 18 and 19 by a pair of covers 28 and 29 which are pivoted and flip into place over respective sprocket wheels 18 and 19. The covers 28 and 29 define a narrow space between the covers 28 and 29 and respective sprocket wheels 18 and 19 which hold the edge strips 26 onto the sprocket teeth 23 but allow enough space to permit unrestricted movement of the edge strips 26 between them.

In FIG. 1, two edge strip trimmers 31 and 32 are shown positioned above the sprocket wheels 18 and 19, respectively. Edge strip trimmers 31 and 32 are identical mirror images of each other. The description will proceed with reference to edge strip trimmer 31, it being understood that the same elements and functions apply equally to edge strip trimmer 32.

Figure 8:
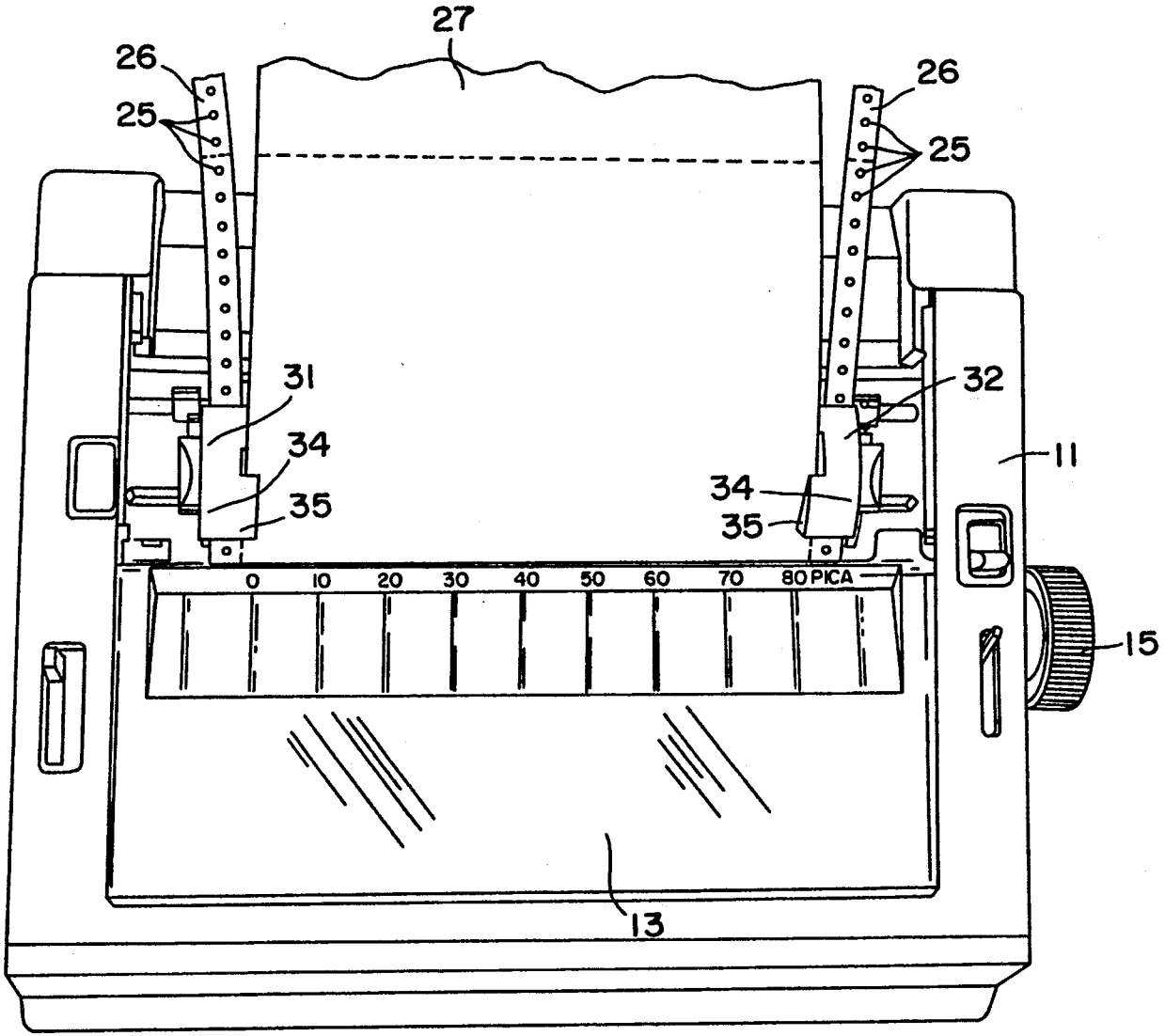
FIG. 8 is a fragmentary perspective view of a printer including a pair of edge strip trimmers in their operative position, showing the edge strips as they are removed.

Edge strip trimmer 31 is positioned by a hinged mounting 33 onto the printer 10 above the sprocket wheel 18. The edge strip trimmer 31 is pivotable between an inoperative position, as shown in FIG. 1, and a closed, operative position shown in FIG. 8. The edge strip trimmer 31 is molded or machined of a durable material such as polystyrene and includes three principle functional zones. An edge strip hold-down means 34 extends along the length of the edge strip trimmer 31 and is positioned in closely spaced-apart relation sprocket wheel 18 and holds the edge strip 26 against the sprocket wheel 26 as the paper is fed through the printer 30.

Figure 7:
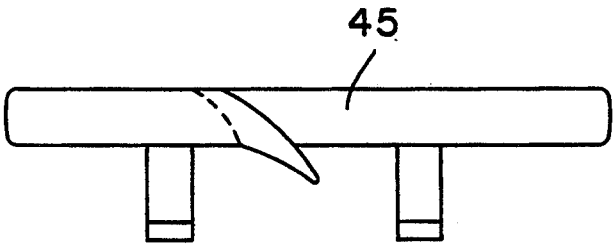
FIG. 7 is a side elevation of an edge strip trimmer for particular use with the sprocket wheel embodiment shown in FIG. 3.

As shown in FIG. 7, according to the embodiment of the sprocket wheel 40 illustrated in FIG. 3, the edge strip hold-down means 45 is preferably straight for being positioned in a closely spaced-apart relation to the flat surface of the upper area 41 of the sprocket wheel 40.

A paper sheet hold-down means 35 extends approximately halfway the length of the edge strip trimmer 31, and holds the paper sheet in the same plane as the edge strip 26 as it passes under the sprocket wheel 18.

Figure 6:
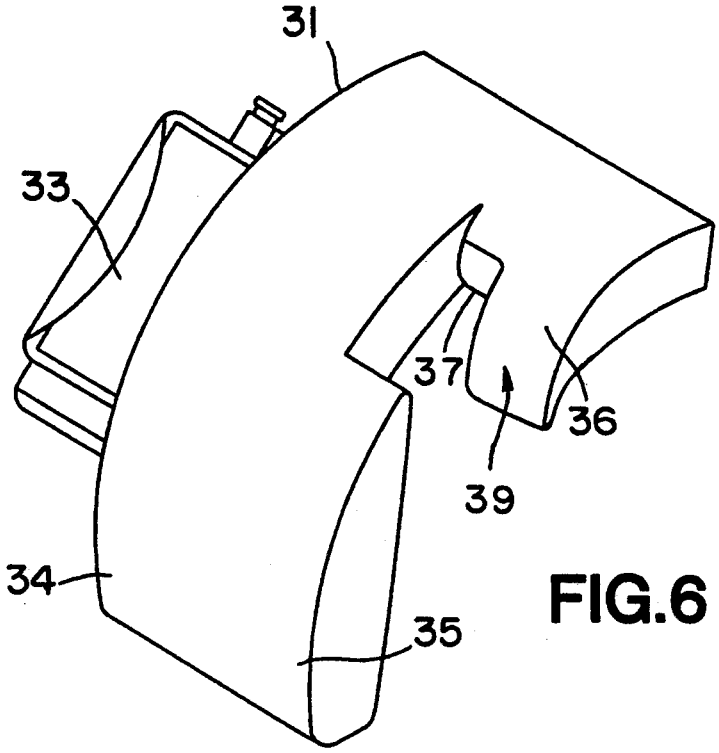
FIG. 6 is a perspective view the edge strip trimmer according to the embodiment of the invention shown in FIGS. 4 and 5.

Separating means for are provided for separating the edge strip 26 from the paper sheet 27. The separating means comprise an inclined paper support bed 36 which extends inwardly from the edge strip hold-down means 34 to a point underneath the horizontal plane of the paper sheet 27. Preferably, the support bed 36 is ramped and progressively diverges the plane of the edge strip 26 from the plane of the paper sheet 27 as the paper sheets 27 are successively fed through the printer 30. As best shown in FIG. 6, the support bed 36 defines an edge surface 39 adjacent the free end of the support bed 36. The edge surface 39 has a gradual compound curve which tapers forwardly in the direction from which the paper sheets 27 are fed through the printer 30, and downwardly beneath the edge strip hold-down means 34. Preferably, the edge surface 39 extends approximately 0.1–0.3 inches below the bottom surface of the edge strip hold-down means 34. This ensures that each successive paper sheet 27 of the length of continuous feed paper 50 will properly pass through the edge strip trimmer 31, and be properly separated from the paper sheet 27. This feature is particularly significant since end sections 54 and 55 of the continuous-feed paper 50 of FIG. 2 are prone to sag in the middle as the paper sheets 27 pass through the printer 10. An edge surface 39 without a downward extension could cause the paper sheet 27 to pass under the support bed 36, and thus, cause the particular edge strip 26*a* or 26*b* not to properly separate from the paper sheet 27.

Separation occurs by moving the paper sheet 27 simultaneously away from the edge strip 26 in a vertical and lateral plane. This causes a progressive simultaneous separation of the edge strip from the paper sheet 27 in two planes.

Figure 5:
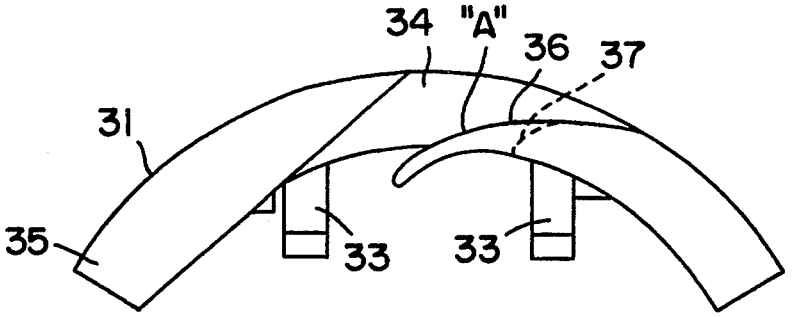
FIG. 5 is a side elevation of the edge strip trimmer according to the embodiment of the invention shown in FIG. 4.
Figure 9:
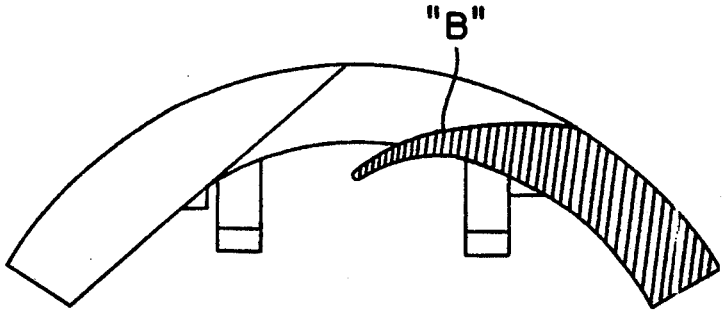
FIG. 9 is a partial cross section of the edge strip trimmer taken substantially along the lines 8—8 of FIG. 4.

The configuration of the compound curve on the support bed 36 is best shown in FIGS. 5 and 9. By comparing the thickness and position of the support bed 36 at point "A" of FIG. 5 and at point "B" of FIG. 9, it can be seen that the support bed 36 at point "B" is thinner than at point "A" as a result of the tapering compound curve. The support bed 36 must be smoothly formed and have even, rounded edges in order to function optimally. A sharp edge will offer too much resistance and cause the edge strips 26 to slip off of the sprocket wheel 18. The slope of the support bed 36 is very gradual so that the resistance of the paper sheet 27 as is slides up the support bed 36 is only very little more than the resistance on the paper sheet 27 during normal feeding through the printer 30.

To provide further downward extension of the support bed 36, an attachment (not shown) having a greater downward slope could be placed over the existing support bed 36. This may be necessary since end sections 54 and 55 of the continuous-feed paper 50 of FIG. 2 are prone to sag.

A notch 37 is formed between the support bed 36 and the center portion of the edge strip hold-down means 34. This notch 37 is in the vertical plane of the perforation between the edge strip 26 and the paper sheet 27. The notch 37 prevents the paper from contacting the support bed at the edge of the notch 37. Contact would tend to cause cutting of the paper sheet 27.

The path of the edge strip 26 and the paper sheet 27 through the edge strip trimmer 31 is illustrated in FIG. 10. Note that the separation of the paper sheet 27 from the edge strip 26 begins upstream of the edge of the support bed 36 so that the angle of separation is very gradual, and extends through the area behind support bed 36, and rides over the support bed 36 to the trailing edge of the support bed 36. Also note that the edge surface 39 of the support bed 36 extends downwardly a sufficient degree to ensure that each end section 54 and 55 of each paper sheet 27 properly passes over the support bed 36.

An edge strip trimmer and a printer having edge strip trimmers is described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

I claim:

1. In a printer having first and second opposed sprocket means positioned on opposed sides of a printer platen for feeding from an upstream to a downstream direction continuous-feed paper sheets having continuous-feed edge strips formed along the opposing sides of the paper sheets, the combination of an edge strip trimming apparatus, said edge strip trimming apparatus comprising first and second edge strip trimmers, each of said edge strip trimmers comprising:

(a) edge strip hold-down means positioned in spaced-apart relation to one of the first and second sprocket means for receiving a sheet of paper to be separated from the edge strip and for holding the edge strip against the sprocket means as the paper is fed through the printer;

(b) separating means for separating the edge strip from the paper sheet, said separating means comprising a paper sheet support bed for extending inwardly from the edge strip hold-down means to a point underneath the horizontal plane of the paper sheet for progressively diverging the plane of the edge strip from the plane of the paper sheet as the paper sheets are successively fed through the printer; and (c) an edge surface defined by said support bed, said edge surface having a gradual compound curve which tapers forwardly in the direction from which the paper sheets are fed through the printer, and downwardly to a point beneath the bottom surface of said edge strip hold-down means, said edge surface extending downwardly to ensure separation of the edge strip from each successive paper sheet as said sheets are progressively fed through the printer.

2. Continuous-feed paper sheets in combination with a printer according to claim 1, wherein said continuous-feed paper sheets comprise:

(a) a multiplicity of adjacent paper sheets aligned end-to-end for being fed into a printer, each of said sheets being defined from adjacent sheets by a cut through the paper, said cut extending transversely from one side edge of the paper sheets to the other side edge of the paper sheets;

(b) first and second continuous paper edge strips formed on opposite side edges of the paper sheets and extending along the length of the continuous-feed paper for carrying the paper sheets therebetween, said first and second edge strips having sprocket holes therein for permitting the edge strips and the paper sheets carried by said edge strips to be continuously fed through a sprocket-driven printer; and (c) said first and second paper edge strips and said paper sheets being separable along the length of the continuous-feed paper between said first paper edge strip and one side edge of said paper sheet and along the length of continuous-feed paper between said second paper edge strip and the other side edge of said paper sheet;

whereby, upon separation of the first and second paper edge strips from the paper sheets, the paper sheets are completely separated from each other.

3. In a printer according to claim 1, wherein said sprocket means comprises a sprocket wheel having sprocket teeth spaced around an axially extending periphery of the sprocket wheel and wherein said edge strip hold-down means is annular for being positioned in closely conforming relation to the curved surface of the sprocket wheel.

4. In a printer according to claim 1, wherein said sprocket means comprises a sprocket wheel having sprocket teeth spaced around the periphery thereof, said sprocket wheel having a relatively flat upper and lower surface and a curved first and second side portion, and wherein said edge strip hold-down means is relatively straight for being positioned in closely conforming relation to one of the relatively flat upper or lower surfaces of the sprocket wheel.

5. In a printer according to claim 1, wherein said edge strip trimmers are integrally formed from a hard plastic material.

6. In a printer according to claim 1, wherein said edge strip trimmers are positioned on pivots for being pivoted into and out of cooperation with said sprocket means.

7. In a printer according to claim 6, wherein said edge strip trimmers are integrally-formed with said pivots.

8. In a printer according to claim 1, and including paper sheet hold-down means attached to said edge strip hold-down means and extending inwardly into the vertical plane of the paper sheet and above the horizontal plane of the paper sheet in upstream orientation to the edge surface for holding the paper sheet close to the platen until separation from the edge strip begins.

9. An edge strip trimmer for being attached to one side of a printer has sprocket means which feeds from an upstream to a downstream direction continuous-feed paper sheets having continuous-feed edge strips formed along the opposing sides of the paper; said edge strip trimmer comprising:

(a) edge strip hold-down means positioned in spaced-apart relation to the sprocket means for receiving a sheet of paper to be separated from the edge strip and for holding the edge strip against the sprocket means as the paper is fed through the printer;

(b) separating means for separating the edge strip from the paper sheet, said separating means comprising an inclined paper support bed for extending inwardly from the edge strip hold-down means to a point underneath the horizontal plane of the paper sheet for progressively diverging the plane of the edge strip from the plane of the paper sheet as the paper sheets are successively fed through the printer; and (c) an edge surface defined by said support bed, said edge surface having a gradual compound curve which tapers forwardly in the direction from which the paper sheets are fed through the printer and downwardly to a point beneath the bottom surface of said edge strip hold-down means, said edge surface extending downwardly to ensure separation of the edge strip from each successive paper sheet as said sheets are progressively fed through the printer.

10. Continuous-feed paper sheets in combination with an edge strip trimmer according to claim 9, wherein said continuous-feed paper sheets comprise:

(a) a multiplicity of adjacent paper sheets aligned end-to-end for being fed into a printer, each of said sheets being defined from adjacent sheets by a cut through the paper, said cut extending transversely from one side edge of the paper sheets to the other side edge of the paper sheets;

(b) first and second continuous paper edge strips formed on opposite side edges of the paper sheets and extending along the length of the continuous-feed paper for carrying the paper sheets therebetween, said first and second edge strips having sprocket holes therein for permitting the edge strips and the paper sheets carried by said edge strips to be continuously fed through a sprocket-driven printer; and (c) said first and second paper edge strips and said paper sheets being separable along the length of the continuous-feed paper between said first paper edge strip and one side edge of said paper sheet and along the length of continuous-feed paper between said second paper edge strip and the other side edge of said paper sheet;

whereby, upon separation of the first and second paper edge strips from the paper sheets, the paper sheets are completely separated from each other.

11. A edge strip trimmer according to claim 9, wherein said edge strip hold-down means is annular for being positioned in closely conforming relation to the curved surface of a sprocket wheel, said sprocket wheel having sprocket teeth spaced around a axially extending periphery thereof.

12. A edge strip trimmer according to claim 9, wherein said sprocket means comprises a sprocket wheel having sprocket teeth spaced around the periphery thereof, said sprocket wheel having a relatively flat upper and lower surface and a curved first and second side portion, and wherein said edge strip hold-down means is relatively straight for being positioned in closely conforming relation to one of the relatively flat upper or lower surfaces of the sprocket wheel.

13. A edge strip trimmer according to claim 9, wherein said edge strip trimmer is positioned on a pivot for being pivoted into and out of cooperation with said sprocket means.

14. A edge strip trimmer according to claim 9, wherein said edge strip trimmer is integrally formed from a hard plastic material.

15. A edge strip trimmer according to claim 13, wherein said edge strip trimmer is integrally-formed with said pivot.

16. A edge strip trimmer according to claim 9, and including paper sheet hold-down means attached to said edge strip hold-down means and extending inwardly into the vertical plane of the paper sheet and above the horizontal plane of the paper sheet in upstream orientation to the edge surface for holding the paper sheet close to the platen until separation from the edge strip begins.

* * * * *